US009097448B2

(12) United States Patent
Jung et al.

(10) Patent No.: US 9,097,448 B2
(45) Date of Patent: Aug. 4, 2015

(54) AIR CONDITIONING SYSTEM AND METHOD FOR CONTROLLING OPERATION THEREOF

(75) Inventors: Yunchul Jung, Seoul (KR); Kibok Lee, Seoul (KR); Seungyong Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1037 days.

(21) Appl. No.: 12/901,869

(22) Filed: Oct. 11, 2010

(65) Prior Publication Data

US 2011/0083455 A1 Apr. 14, 2011

(30) Foreign Application Priority Data

Oct. 12, 2009 (KR) ..... 10-2009-0096921
Apr. 8, 2010 (KR) ..... 10-2010-0032448

(51) Int. Cl.

| | |
|---|---|
| ***F25B 41/04*** | (2006.01) |
| ***F25B 41/00*** | (2006.01) |
| ***F25B 49/02*** | (2006.01) |
| *F24F 11/00* | (2006.01) |

(52) U.S. Cl.

CPC ..... *F25B 49/02* (2013.01); *F24F 2011/0082* (2013.01); *F25B 2500/06* (2013.01); *F25B 2600/2513* (2013.01); *F25B 2700/15* (2013.01)

(58) Field of Classification Search

CPC ..... F25B 2600/2513; F25B 2700/15
USPC ..... 62/204, 210, 211, 222, 223
See application file for complete search history.

(56) References Cited

U.S. PATENT DOCUMENTS

| | | | | |
|---|---|---|---|---|
| 5,142,879 | A * | 9/1992 | Nakamura et al. | 62/160 |
| 5,630,325 | A * | 5/1997 | Bahel et al. | 62/222 |
| 5,934,094 | A * | 8/1999 | Itoh et al. | 62/222 |
| 6,321,548 | B1 * | 11/2001 | Clarke et al. | 62/222 |
| 7,000,422 | B2 * | 2/2006 | Street et al. | 62/298 |
| 2003/0074910 | A1 * | 4/2003 | Moon et al. | 62/196.4 |
| 2005/0097920 | A1 * | 5/2005 | Ezaki et al. | 62/527 |
| 2005/0126218 | A1 * | 6/2005 | Sohn | 62/527 |
| 2005/0159847 | A1 * | 7/2005 | Shah et al. | 700/276 |
| 2006/0086104 | A1 * | 4/2006 | Chang et al. | 62/129 |
| 2007/0204635 | A1 * | 9/2007 | Tanaka et al. | 62/129 |
| 2009/0235678 | A1 * | 9/2009 | Taras et al. | 62/115 |
| 2009/0241566 | A1 * | 10/2009 | Bush et al. | 62/115 |
| 2011/0016897 | A1 * | 1/2011 | Akagi et al. | 62/161 |
| 2011/0083455 | A1 * | 4/2011 | Jung et al. | 62/115 |

* cited by examiner

*Primary Examiner* — M. Alexandra Elve
*Assistant Examiner* — Henry Crenshaw
(74) *Attorney, Agent, or Firm* — McKenna Long & Aldridge LLP

(57) ABSTRACT

Disclosed are an air conditioning system and a method for controlling an operation thereof, whereby a charging device for charging power to be supplied into the indoor unit is employed, a chargeable control unit is separately employed, or a separate control unit connectable between the indoor unit and an electronic expansion valve is employed, thereby closing the electronic expansion valve even if power supplied into the indoor unit is blocked while controlling opening and closing of the electronic expansion valve, and additionally preventing the electronic expansion valve from being left open, resulting in prevention of an overload of a compressor within an indoor unit.

4 Claims, 6 Drawing Sheets

AIR CONDITIONING SYSTEM AND METHOD FOR CONTROLLING OPERATION THEREOF

CROSS-REFERENCE TO RELATED APPLICATION

Pursuant to 35 U.S.C. §119(a), this application claims the benefit of earlier filing date and right of priority to Korean Application No. 10-2009-0096921, filed on Oct. 12, 2009, and No. 10-2010-0032448, filed on Apr. 8, 2010, the contents of which is incorporated by reference herein in its entirety.

BACKGROUND OF THE INVENTION

1. Field of the Invention

The present invention relates to an air conditioning system, and particularly, to an air conditioning system capable of controlling opening and closing of an electronic expansion valve even when power supplied into an indoor unit is blocked while driving the electronic expansion valve, and a method for controlling an operation thereof.

2. Background of the Invention

In general, an air conditioning system includes a compressor for compressing a refrigerant into a state of high temperature and high pressure, a condenser for heat exchanging the high-temperature and high-pressure refrigerant transferred from the compressor with ambient air so as to convert into a liquid state of low temperature and high pressure, an expansion valve for decompressing the refrigerant converted in the liquid state by the condenser into a liquid or gaseous state of low temperature and low pressure, an evaporator for maintaining a low external temperature by allowing the low-temperature and low-pressure refrigerant to flow therethrough, a blow fan for discharging the cooled air by the evaporator into a room, an accumulator for filtering the refrigerant in the liquid state from the refrigerant gas evaporated by the evaporator so as to be introduced back into the compressor, and a controller for controlling an entire operation of the air conditioning system.

Meanwhile, the air conditioning system may be classified according to the type and the number of components, such as an indoor unit, an outdoor unit, a controller, a connection pipe and the like. Namely, a rotary air conditioner may be composed of one indoor unit and one outdoor unit, a unitary air conditioner may be provided with one outdoor unit, one or more indoor units and a duct, and a multi air conditioner may be comprised of one or more outdoor units, one or more indoor units and a central control unit.

An air conditioning system may typically include a compressor and a condenser within an outdoor unit, and an evaporator, a blow fan and a controller within an indoor unit. The indoor unit may perform air conditioning of each room (chamber), and the outdoor unit may monitor state information relating to an indoor unit connected thereto so as to control a refrigerant to be distributed and circulated into the connected indoor unit. The air conditioning system may consume considerable power, due to its characteristic of performing the air conditioning by circulating the refrigerant, as compared to other home alliances, thereby increasing the burden on maintenance cost.

However, regarding the indoor unit of the air conditioning system and a method of controlling the operation thereof according to the related art, the controller, which has been supplied with a voltage of 12V from a power supply unit, typically outputs a driving signal to open and close the electronic expansion valve. If the power supplied into the indoor unit is blocked while the controller controls opening and closing of the electronic expansion valve, the electronic expansion valve may problematically be left open.

Also, if the electronic expansion valve is left open, a refrigerant pipe remains in an open state and the compressor of the outdoor unit is converted into an overload state, which may cause the air conditioning system to be out of order.

SUMMARY OF THE INVENTION

Therefore, to overcome those problems of the related art, an object of the present invention is to provide an air conditioning system having an indoor unit, capable of opening and closing an electronic expansion valve even when power supplied to the indoor unit is blocked while controlling opening and closing of the electronic expansion valve, and a method for controlling an operation thereof.

Another object of the present invention is to provide an air conditioning system having an indoor unit, capable of opening and closing an electronic expansion valve by continuously supplying power, by virtue of employment of a separate power supply unit, even when power supplied to the indoor unit is blocked while controlling opening and closing of the electronic expansion valve, and a method for controlling an operation thereof.

Another object of the present invention is to provide an air conditioning system having an indoor unit capable of opening and closing an electronic expansion valve, by virtue of employment of a separate chargeable controller, even when power supplied to the indoor unit is blocked while controlling opening and closing of the electronic expansion valve, and a method for controlling an operation thereof.

Another object of the present invention is to provide an air conditioning system having an indoor unit capable of opening and closing an electronic expansion valve, by virtue of employment of a separate controller, which is chargeable and connectable between the indoor unit and the electronic expansion valve, even when power supplied to the indoor unit is blocked while controlling opening and closing of the electronic expansion valve, and a method for controlling an operation thereof.

To achieve these and other advantages and in accordance with the purpose of the present invention, as embodied and broadly described herein, there is provided an air conditioning system including an outdoor unit having a compressor for distributing a refrigerant, one or more indoor units each connected to the outdoor unit for performing an air conditioning operation, and an electronic expansion valve configured to adjust an amount of the refrigerant flowing, wherein the indoor unit includes a power supply unit connected to an external power source to supply power into the indoor unit, a control unit configured to receive power supplied from the power supply unit and generate a valve driving signal for controlling opening and closing of the electronic expansion valve, and an auxiliary power supply unit charged by being connected to the power supply unit and configured to supply power to the control unit and the electronic expansion valve if power supplied into the indoor unit is blocked. Here, the auxiliary power supply unit may include a capacitor charged by being connected to the power supply unit and supplying the charged power.

In accordance with another embodiment of the present invention, there is provided an air conditioning system including an outdoor unit having a compressor for distributing a refrigerant, one or more indoor units each connected to the outdoor unit for performing an air conditioning operation, and an electronic expansion valve for adjusting an amount of refrigerant flowing, wherein the indoor unit includes a power supply unit connected to an external power source for supplying power into the indoor unit, an indoor unit control unit configured to receive power supplied from the power supply unit and generate a valve driving signal for controlling opening and closing of the electronic expansion valve, and an auxiliary control unit configured to generate a valve closing signal for closing the electronic expansion valve based upon a state of power supplied into the indoor unit.

The auxiliary control unit may include a control module configured to detect the state of the power supplied into the indoor unit and generate the valve closing signal if the power is detected to be blocked, and an auxiliary power supply module configured to supply power to the control module. Here, the auxiliary power supply module may include a capacitor charged by being connected to the power supply unit or supplying the charged power.

In accordance with another embodiment of the present invention, there is provided an air conditioning system including an outdoor unit having a compressor for distributing a refrigerant, one or more indoor units each connected to the outdoor unit for performing an air conditioning operation, an electronic expansion valve configured to adjust an amount of the refrigerant flowing, and an individual control unit connected between the indoor unit and the electronic expansion valve and configured to detect a state of power supplied into the indoor unit to control opening and closing of the electronic expansion valve based upon the detection result.

The indoor unit may include a power supply unit connected to an external power source to supply power into the indoor unit, an indoor unit control unit configured to receive power supplied from the power supply unit and generate a valve driving signal for controlling opening and closing of the electronic expansion valve, and an electronic expansion valve driving unit configured to drive the electronic expansion valve based upon the valve driving signal.

The individual control unit may include a control module configured to detect the state of the power supplied into the indoor unit and generate a valve closing signal for closing the electronic expansion valve if power is detected to be blocked, a driving module configured to close the electronic expansion valve based upon the valve closing signal, and an auxiliary power supply module configured to supply power to the control module and the driving module. Here, the auxiliary power supply module may include a capacitor charged by being connected to the power supply unit or supplying the charged power.

In accordance with one embodiment of the present invention, there is provided a method for controlling an operation of an air conditioning system, in a method for controlling an indoor unit including a power supply unit connected to an external power source for supplying power to the indoor unit, and an auxiliary power supply unit charged by being connected to the power supply unit or supplying the charged power, the method including charging the auxiliary power supply unit, determining whether or not the power supply unit supplies power to the indoor unit, and opening or closing an electronic expansion valve by receiving power supplied from the power supply unit or from the auxiliary power supply unit.

In accordance with another embodiment of the present invention, there is provided a method for controlling an operation of an air conditioning system, in a method for controlling an indoor unit including an indoor unit comprising a power supply unit connected to an external power source to supply power into the indoor unit, an indoor unit control unit configured to receive power supplied from the power supply unit and generate a valve driving signal for controlling opening and closing of the electronic expansion valve, and an auxiliary control unit configured to generate a valve closing signal for closing the electronic expansion valve based upon a state of power supplied into the indoor unit, the method including detecting the state of the power supplied into the indoor unit, and closing the electronic expansion valve according to the valve closing signal generated by the auxiliary control unit if the power supplied into the indoor unit is detected to be blocked.

In accordance with another embodiment of the present invention, there is provided a method for controlling an operation of an air conditioning system, in an air conditioning system comprising an outdoor unit having a compressor for distributing a refrigerant, one or more indoor units each connected to the outdoor unit for performing an air conditioning operation, an electronic expansion valve configured to adjust an amount of the refrigerant flowing, and an individual control unit connected between the indoor unit and the electronic expansion valve, the method including detecting a state of power supplied into the indoor unit, and generating by the individual control unit a valve closing signal for closing the electronic expansion valve if the power supplied into the indoor unit is detected to be blocked.

In accordance with an indoor unit, an air conditioning system having the indoor unit and a method for controlling an operation of the air conditioning system of the present invention, a charging device for charging power to be supplied into the indoor unit can be employed, thereby supplying power so as to allow a continuous control of opening and closing of an electronic expansion valve even if power supplied into the indoor unit is blocked while controlling opening and closing of the electronic expansion valve.

The present invention may separately employ a chargeable control unit so as to close the electronic expansion valve even if power supplied into the indoor unit is blocked while controlling opening and closing of the electronic expansion valve.

The present invention may separately employ a control unit, which is chargeable and connectable between the indoor unit and the electronic expansion valve, so as to close the electronic expansion valve even if power supplied into the indoor unit is blocked while controlling opening and closing of the electronic expansion valve. Also, the control device can be detachably connected to the air conditioning system to perform the above operation, thereby improving stability of the system and a user's convenience.

The present invention can prevent the electronic expansion valve from being left open continuously, thereby preventing an overload state of a compressor within the indoor unit, resulting in reducing the chance of a breakdown of the system.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of an indoor unit, an air conditioning system having the indoor unit, and a method for controlling an operation of the air conditioning system in accordance with the preferred embodiments of the present invention, with reference to the accompanying drawings.

Figure 1:
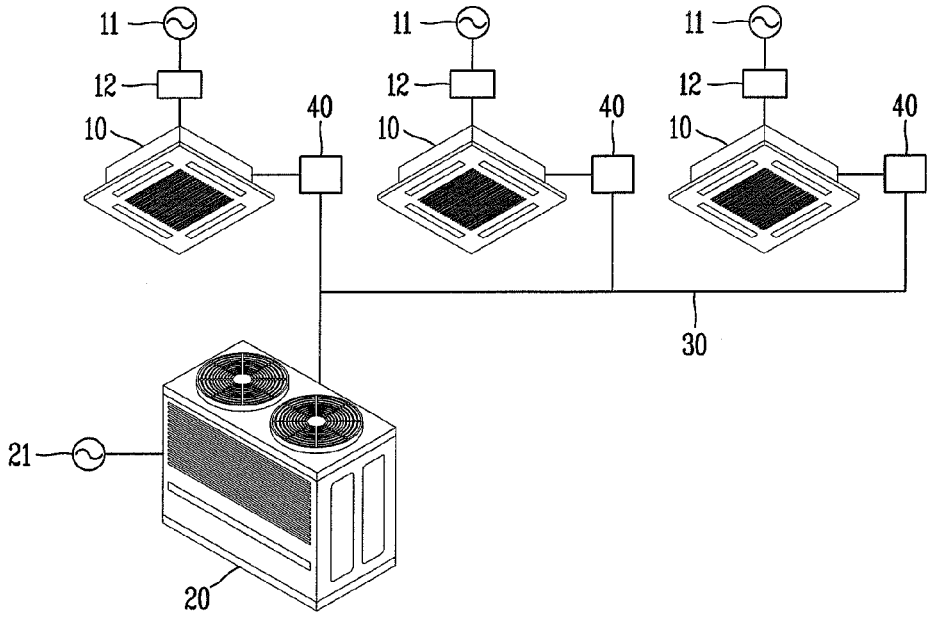
FIG. 1 is a view schematically showing an overall structure of an air conditioning system in accordance with the present invention.

FIG. 1 shows an overall structure of an air conditioning system according to the present invention, which shows an air conditioning system having indoor units each connected to an individual external power source and all connected in parallel. In some cases, the present invention may be applied to another type of connection structure of an indoor unit and an outdoor unit. Referring to FIG. 1, an outdoor unit 20 is connected to an outdoor unit power supply unit 21, and connected to one or more indoor units 10 via a refrigerant pipe 30. The indoor units 10 are connected to respective indoor unit power supply unit 11, and a breaker 12 is connected between the indoor unit power supply unit 11 and the indoor unit 10. For instance, 380V 3-phase 4-wire system may be used as the outdoor unit power supply unit 21, and 220V single-phase system may be used as the indoor unit power source 11. Also, the indoor unit 10 may includes an electronic expansion valve (EEV) 40 for adjusting an amount of a refrigerant flowing. The electronic expansion valve may be located outside the indoor unit 310 (referring to FIG. 5-7).

Figure 2:
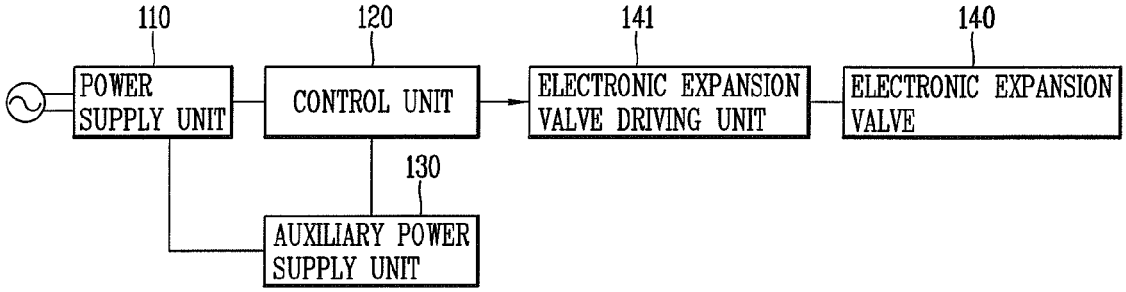
FIG. 2 is a block diagram schematically showing a configuration of an air conditioning system in accordance with one embodiment of the present invention.

Referring to FIG. 2, an indoor unit for an air conditioning system according to one embodiment of the present invention may include a power supply unit 110 connected to an external power source for supplying power, a control unit 120 for receiving power supplied from the power supply unit 110 and generating a valve driving signal to open and close an electronic expansion valve 140, and an auxiliary power supply unit 130 chargeable by being connected to the power supply unit 110 and supplying power to the control unit 120 when power supplied from the power supply unit 110 is blocked.

The power supply unit 110 may receive the external power, namely, an alternating-current (AC) voltage to output a direct-current (DC) voltage for operating circuits, units and the like constructing the indoor unit. In general, a switched-mode power supply (SMPS) is used as the power supply unit 110. Another type of AC-DC converter may alternatively be used in addition to the SMPS. The SMPS may rectify and smooth an AC voltage of external power to convert the same into a DC voltage, and generate driving voltages required for the indoor unit from the DC voltage by use of a transformer, such as a high frequency transformer, a regulator and the like.

The control unit 120 may receive driving voltage input from the power supply unit 110 and drive the indoor unit using the driving voltage. Also, the control unit 120 may output a valve driving signal for controlling opening and closing of the electronic expansion valve 140 to an the electronic expansion valve driving unit 141.

The auxiliary power supply unit 130 may be connected to the power supply unit 110 to be charged while inputting power into the indoor unit, and outputs the charged voltage when power input into the indoor unit is blocked. The auxiliary power supply unit 130 may output a driving voltage for driving the control unit 120 and a driving voltage for driving the electronic expansion valve 140.

Figure 8:
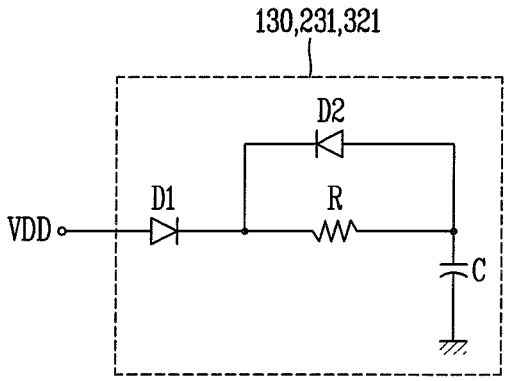
FIG. 8 is a block diagram showing a detailed configuration of an auxiliary power supply unit or an auxiliary power supply module of FIGS. 1 to 7.

Referring to FIG. 8, the auxiliary power supply unit 130 may include a capacitor C, which is charged by being connected to the power supply unit 110 or supplies the charged power. The capacitor C may be a capacitor having a large capacity of several farads (e.g., 1.06 F, 1.67 F) and excellent output characteristics, and be charged with a voltage output from the power supply unit 110. The capacity of the capacitor C may depend on driving power and driving time of the electronic expansion valve 140. The capacitor C may be continuously charged during power supply to the indoor unit, or charged until reaching a preset voltage. Here, the auxiliary power supply unit 130 may further include a zener diode (not shown) for setting a charge reference voltage of the capacitor C. The auxiliary power supply unit 130 may further include diodes D1 and D2 defining a current path. Also, the auxiliary power supply unit 130 may further include a resistance R for preventing an over-current.

The auxiliary power supply unit 130 may further include a converter (not shown) for converting the charged voltage in the capacitor C to output a preset voltage. The converter may be a DC-DC converter, for example, a regulator. For instance, a voltage of 12V is charged in the capacitor C, the converter may convert the voltage into a voltage of 5V so as to output to the control unit 120 as a driving voltage thereof.

The indoor unit for the air conditioning system according to the one embodiment of the present invention starts an air conditioning operation by using power input from the power supply unit 110, and charges a surplus voltage in the auxiliary power supply unit 130. The control unit 120 may determine whether or not power is continuously supplied from the power supply unit 110, and if the power is determined to be continuously supplied into the indoor unit, the control unit 120 outputs a control signal by receiving power supplied from the power supply unit 110, thereby controlling opening and closing of the electronic expansion valve 140 based upon the control signal. On the other hand, if the power supplied from the power supply unit 110 is determined to be blocked, the control unit 120 outputs a control signal by receiving power supplied from the auxiliary power supply unit 130, thereby controlling opening and closing of the electronic expansion valve 140 based upon the control signal. The operation of determining whether or not power is applied into the indoor unit was described as being performed by the control unit 120. Alternatively, another configuration may be implemented that the power supply unit 110 and the auxiliary power supply unit 130 may be connected in parallel, and if a voltage is not output from the power supply unit 110, a voltage is automatically received via the auxiliary power supply unit 130.

Figure 3:
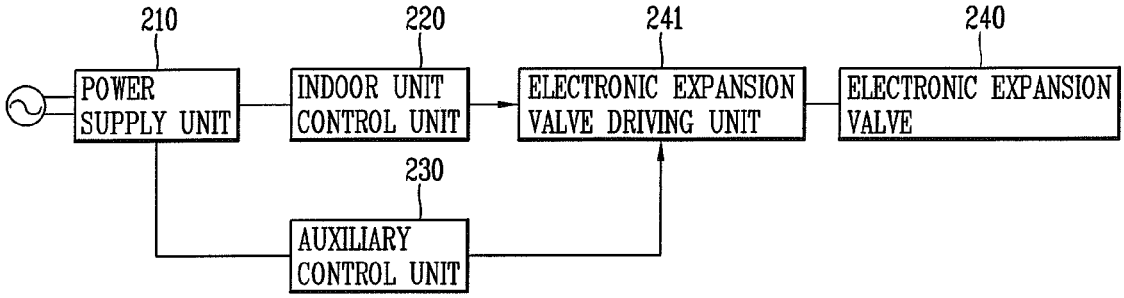
FIG. 3 is a block diagram schematically showing a configuration of an air conditioning system in accordance with another embodiment of the present invention.

Referring to FIG. 3, an indoor unit for an air conditioning system according to another embodiment of the present invention may include a power supply unit 210 connected to an external power source for supplying power, a control unit 220 receiving power supplied from the power supply unit 210 and generating a valve driving signal for controlling opening and closing of an electronic expansion valve 240, and an auxiliary control unit 230 generating a valve closing signal for closing the electronic expansion valve based upon a state of the power supplied from the power supply unit 210.

Figure 4:
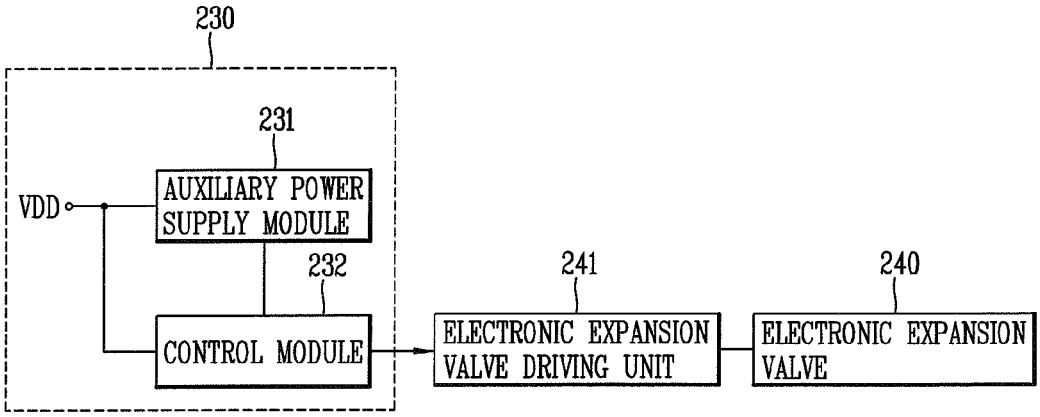
FIG. 4 is a block diagram schematically showing a configuration of an auxiliary control unit of FIG. 3.

Referring to FIG. 4, the auxiliary control unit 230 may include a control module 232 for detecting the state of power supplied from the power supply unit 210, and generating the valve closing signal if the power is detected to be blocked, and an auxiliary power supply module 231 for supplying power to the control module 232.

The power supply unit 210 may be an AC-DC converter, such as SMPS, for receiving the external power, namely, AC power to output a DC voltage for driving circuits, units and the like constructing the indoor unit. The SMPS may rectify and smooth an AC voltage of external power to convert the same into a DC voltage, and generate driving voltages required for the indoor unit from the DC voltage by use of a transformer, such as a high frequency transformer, a regulator and the like.

The indoor unit for the air conditioning system according to the another embodiment of the present invention starts an air conditioning operation by receiving power applied from the power supply unit 210. The indoor unit control unit 220 outputs a control signal by receiving power supplied from the power supply unit 210 if the power supply unit 210 continuously applies power to the indoor unit, thereby operating the indoor unit or controlling opening or closing of the electronic expansion valve 240 based upon the control signal. If the power applied to the indoor unit is blocked while driving the electronic expansion valve 240, the driving of the electronic expansion valve 240 by the indoor unit control unit 220 may be stopped, and the electronic expansion valve 240 may be left open. Here, the auxiliary control unit 230 continuously detects the power supply state from the power supply unit 210, and then if power supply is sustained, generates a signal for closing the electronic expansion valve 240. The auxiliary control unit 230 may include an auxiliary power supply module 231 charged while power is applied from the power supply unit 210, and a control module 232 for detecting a power supply state from the power supply unit 210. The control module 232 may generate a signal for closing the electronic expansion valve 240 by receiving power from the auxiliary power supply module 231 when the power supply from the power supply unit 210 is blocked, and then closes the electronic expansion valve based upon the signal.

Referring to FIG. 8, the auxiliary power supply module 231 may include a capacitor C, which is charged by being connected to the power supply unit 210 or supplies the charged power. The capacitor C may be a capacitor having a large capacity of several farads (e.g., 1.06 F, 1.67 F) and excellent output characteristics, and be charged with a voltage output from the power supply unit 210. The capacity of the capacitor C may depend on driving power and driving time of the electronic expansion valve 240. The capacitor C may be continuously charged during power supply to the indoor unit, or charged until reaching a preset voltage. Here, the auxiliary power supply unit 230 may further include a zener diode (not shown) for setting a charge reference voltage of the capacitor C. The auxiliary power supply unit 230 may further include diodes D1 and D2 defining a current path. Also, the auxiliary power supply unit 130 may further include a resistance R for preventing an over-current.

Referring to FIG. 2, the air conditioning system according to the one embodiment of the present invention may include an outdoor unit having a compressor for distributing a refrigerant, one or more indoor units each connected to the outdoor unit for performing an air conditioning operation, and an electronic expansion valve 140 for adjusting an amount of the refrigerant flowing. The indoor unit may include a power supply unit 110 connected to an external power source for supplying power, a control unit 120 for receiving power supplied from the power supply unit 110 and generating a valve driving signal to open and close an electronic expansion valve 140, and an auxiliary power supply unit 130 chargeable by being connected to the power supply unit 110 and supplying power to the control unit 120 and the electronic expansion valve 140 when power supplied from the power supply unit 110 is blocked. Referring to FIG. 8, the auxiliary power supply unit 130 may include a capacitor C, which is charged by being connected to the power supply unit 110 or supplies the charged power. The configuration of the air conditioning system will be understood by the description of the indoor unit for the air conditioning system according to the one embodiment, so the description thereof will be omitted.

In the air conditioning system according to the present invention, the indoor unit starts an air conditioning operation by receiving power applied from the power supply unit 110, and charges a surplus voltage into the auxiliary power supply unit 130. The indoor unit determines whether or not power is continuously supplied from the power supply unit 110, and if the power is determined to be continuously supplied into the indoor unit, the indoor unit outputs a control signal to an electronic expansion valve driving unit 141 by receiving power supplied from the power supply unit 110. On the other hand, if power supplied to the indoor unit is blocked, the indoor unit 130 outputs a control signal to the electronic expansion valve driving unit 141 by receiving power supplied from the auxiliary power supply unit 130.

Referring to FIGS. 3 and 4, an air conditioning system according to another embodiment of the present invention may include an outdoor unit having a compressor for distributing a refrigerant, one or more indoor units each connected to the outdoor unit for performing an air conditioning operation, and an electronic expansion valve 240 for adjusting an amount of the refrigerant flowing. The indoor unit may include a power supply unit 210 connected to an external power source for supplying power into the indoor unit, a control unit 220 for receiving power supplied from the power supply unit 210 and generating a valve driving signal to open and close an electronic expansion valve 240, and an auxiliary control unit 230 for generating a valve closing signal for closing the electronic expansion valve 240 based upon a state of power supplied to the indoor unit.

Referring to FIG. 4, the auxiliary control unit 230 may include a control module 232 for detecting the state of power supplied into the indoor unit, and generating the valve closing signal if the power is detected to be blocked, and an auxiliary power supply module 231 for supplying power to the control module 232. Referring to FIG. 8, the auxiliary power supply module 231 may include a capacitor C, which is charged by being connected to the power supply unit 210 or supplies the charged power.

In the air conditioning system according to the another embodiment of the present invention, the indoor unit starts an air conditioning operation by receiving power supplied from the power supply unit 210. The indoor unit control unit 220 may operate the indoor unit or outputs a signal for driving the electronic expansion valve 240 to the electronic expansion valve driving unit 241 by receiving power supplied from the power supply unit 210 if the power is continuously supplied from the power supply unit 210 into the indoor unit. If the power supply into the indoor unit is sustained during operation of the electronic expansion valve 240, the driving of the electronic expansion valve by the indoor unit control unit 220 may be stopped and the electronic expansion valve may be continuously left open. Here, the auxiliary control unit 230 continuously detects the power supply state from the power supply unit 210, and then if power supply is sustained, outputs a signal for closing the electronic expansion valve to the electronic expansion valve driving unit 241.

Figure 5:
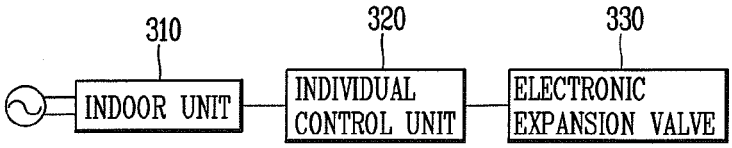
FIG. 5 a block diagram schematically showing a configuration of an air conditioning system in accordance with another embodiment of the present invention.

Referring to FIG. 5, an air conditioning system according to another embodiment of the present invention may include an outdoor unit having a compressor for distributing a refrigerant, one or more indoor units 310 each connected to the outdoor unit for performing an air conditioning operation, an electronic expansion valve 330 for adjusting an amount of the refrigerant flowing, and an individual control unit 320 connected between the indoor unit 310 and the electronic expansion valve 330 for detecting a state of power supplied into the indoor unit 310 so as to control opening and closing of the electronic expansion valve 330 based upon the detection result.

Figure 6:
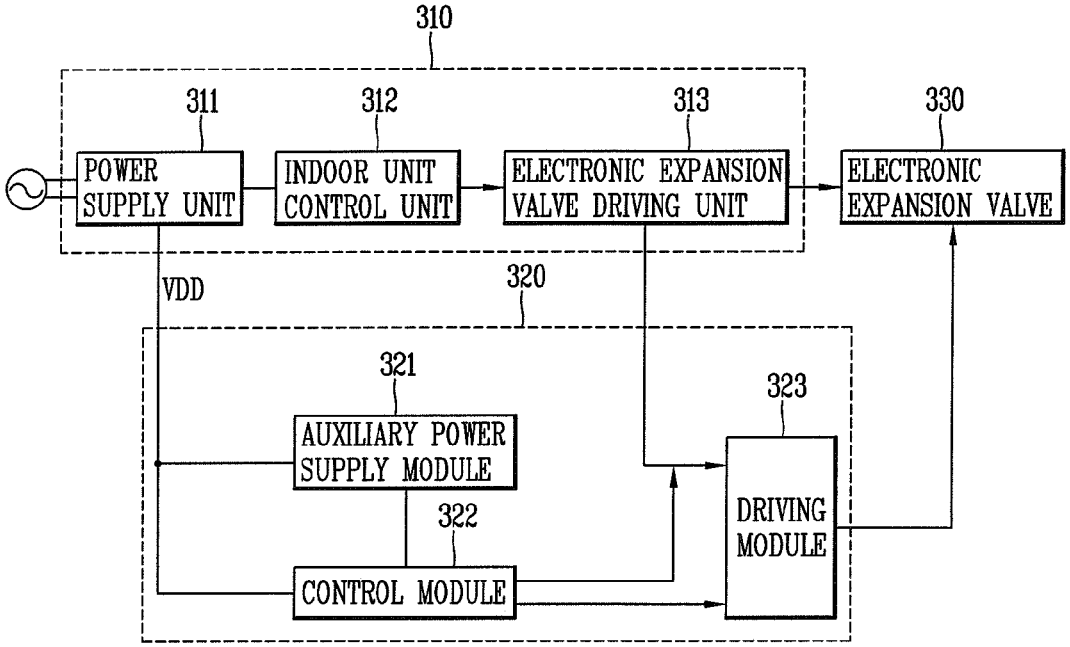
FIG. 6 is a block diagram showing a detailed configuration of FIG. 5.

Referring to FIG. 6, the indoor unit 310 may include a power supply unit 311 connected to an external power source for supplying power into the indoor unit 310, an indoor unit control unit 312 receiving power supplied from the power supply unit 311 and generating a valve driving signal for controlling opening and closing of the electronic expansion valve 330, and an electronic expansion valve driving unit 313 for driving the electronic expansion valve based upon the valve driving signal.

The power supply unit 311 may be an AC-DC converter, such as SMPS, for receiving the external power, namely, AC power to output a DC voltage for driving circuits, units and the like constructing the indoor unit. The SMPS may rectify and smooth an AC voltage of external power to convert the same into a DC voltage, and generate driving voltages required for the indoor unit from the DC voltage by use of a transformer, such as a high frequency transformer, a regulator and the like.

Referring to FIG. 6, the individual control unit 320 may include a control module 322 for detecting a state of power supplied into the indoor unit 310, and generating a valve closing signal for closing the electronic expansion valve 330 if the power is detected to be blocked, a driving module 323 for driving the electronic expansion valve 330 based upon the valve driving signal or the valve closing signal, and an auxiliary power supply module 321 for supplying power to the control module 322 and the driving module 323. The individual control unit 320 may be detachable between the one or more indoor units 310 and the electronic expansion valve 330. That is, the individual control unit 320 may be provided with an input terminal and an output terminal, thereby being connected to an output terminal of the indoor unit control unit 312 via the input terminal and connected to the electronic expansion valve 330 via the output terminal.

In the air conditioning system according to the another embodiment of the present invention, the indoor unit 310 converts an AC voltage, which is input from an external power source via the power supply unit 311, into a DC voltage and starts an air conditioning operation using the DC voltage. The indoor unit control unit 312 operates the indoor unit 310 or generates the valve driving signal to control opening or closing of the electronic expansion valve 330 via the electronic expansion valve driving unit 313, by receiving power supplied from the power supply unit 311, if power is continuously supplied from the power supply unit 311 into the indoor unit 310.

Here, if the individual control unit 320 is in a connected state with the indoor unit 310, the indoor unit control unit 312 outputs the valve driving signal to the individual control unit 320. That is, the driving module 323 receives the valve driving signal from the indoor unit 310, so as to drive the electronic expansion valve 330 based upon the valve driving signal. Also, if the individual control unit 320 is in a connected state with the indoor unit 310, the individual control unit 320 continuously detects the state of power supplied into the indoor unit. The individual control unit 320 then generates the valve closing signal when it detects that the power supplied into the indoor unit is blocked during operation of the electronic expansion valve 330.

The control module 322 receives power by being connected to the power supply unit 311 and simultaneously continuously detects the power supply state from the power supply unit 311. Also, the control module 322 outputs a valve closing signal to the driving module 323 if the power is detected to be blocked, and the driving module 323 then closes the electronic expansion valve 330 according to the valve closing signal other than the valve driving signal. Here, the control module 322 receives power supplied from the auxiliary power supply module 321. That is, the auxiliary power supply module 321 is connected to the power supply unit 311 to be charged with power therefrom, and supplies the charged power to the control module 322 and the driving module 323. The individual control unit 320 may include a converter, for example, a regulator, for converting a charged voltage into a preset voltage.

The driving module 323 receives power supplied from the auxiliary power supply module 321 and drives the electronic expansion valve 330 based upon the valve driving signal or the valve closing signal. Here, the driving module 323 corresponds to the electronic expansion valve driving unit 313 in view of its functionality. That is, the driving module 323 may normally drive the electronic expansion module based upon the valve driving signal generated by the indoor unit control unit 312, and closes the electronic expansion valve 330 based upon the valve closing signal generated by the control module 322 upon blocking power supply into the indoor unit.

Figure 7:
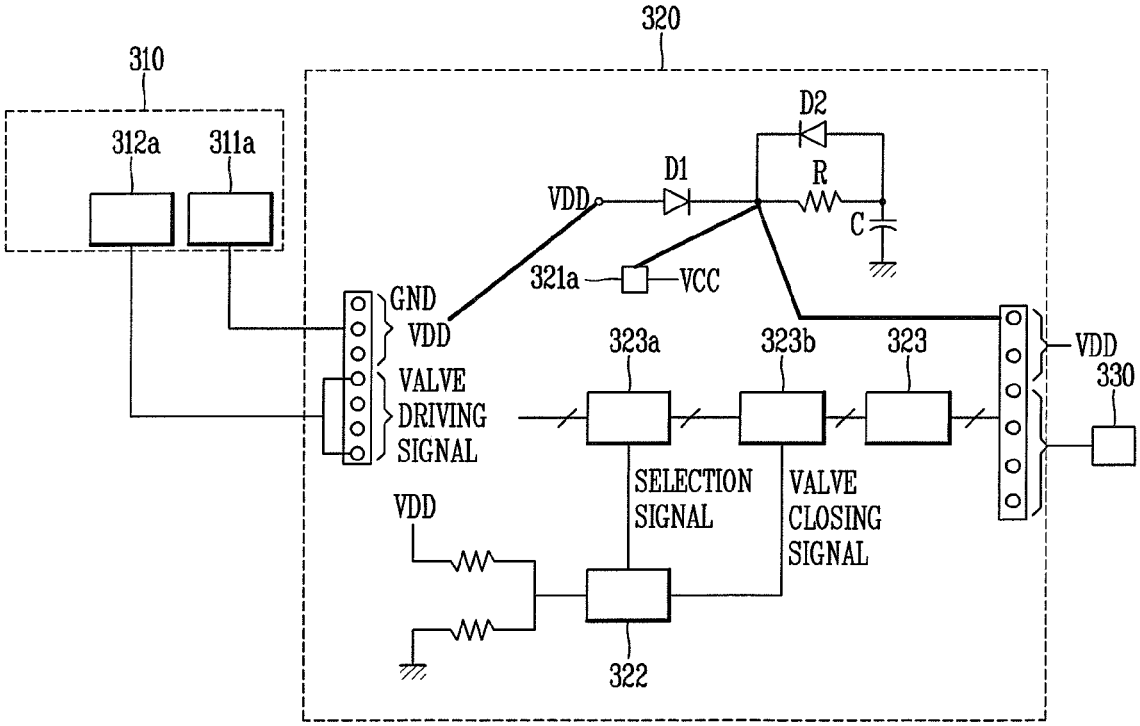
FIG. 7 is a view showing a detailed configuration of an individual control unit of FIG. 5 or 6.

FIG. 7 exemplarily shows a circuit configuration of the individual control unit of FIG. 5 or 6. The individual control unit 320 receives a preset voltage VDD by being connected to a power supply connection terminal 311*a* of the indoor unit 310, and receives a valve driving signal by being connected to an output terminal 312*a* of the indoor unit control unit 312. The control module 322 within the individual control unit 320 detects whether or not power supply into the indoor unit 310 is blocked based upon a voltage input from the indoor unit 310, and outputs a selection signal according to the detection result. Here, reference numerals 323*a* and 323*b* denote buffers, or logics, circuits, modules or the like which perform the similar function to the buffers. The control module 322 outputs a valve closing signal to the driving module 323 via 323*b* when the power supply into the indoor unit is blocked, and transfers the valve driving signal to the driving module 323 if the power supply is detected as a normal state. The control module 322 and the driving module 323 receive power supplied from the auxiliary power supply module 321. The auxiliary power supply module 321 may be provided with a super capacitor so as to charge the capacitor with a voltage, for example, VDD, input from the indoor unit 310, thereby supplying the charged voltage to the circuits, logic, modules or the like constructing the individual control unit 320 when power supplied to the indoor unit 310 is blocked. The auxiliary power supply module 321 may include a regulator 321*a* for converting the VDD into a preset VCC. For instance, the VDD may be 12V and the VCC may be 5V, accordingly, the control module 322 may receive the VCC and the driving module 323 may receive the VDD.

Referring to FIG. 8, the auxiliary power supply module 321 may include a capacitor C, which is charged by being connected to the power supply unit 311 or supplies the charged power. The capacitor C may be a capacitor having a large capacity of several farads (e.g., 1.06 F, 1.67 F) and excellent output characteristics, and be charged with a voltage output from the power supply unit 311. The capacity of the capacitor C may depend on driving power and driving time of the electronic expansion valve 330. The capacitor C may be continuously charged during power supply to the indoor unit, or charged until reaching a preset voltage. Here, the auxiliary power supply unit 311 may further include a zener diode (not shown) for setting a charge reference voltage of the capacitor C. The auxiliary power supply unit 321 may further include diodes D1 and D2 defining a current path. Also, the auxiliary power supply unit 321 may further include a resistance R for preventing an over-current.

Figure 9:
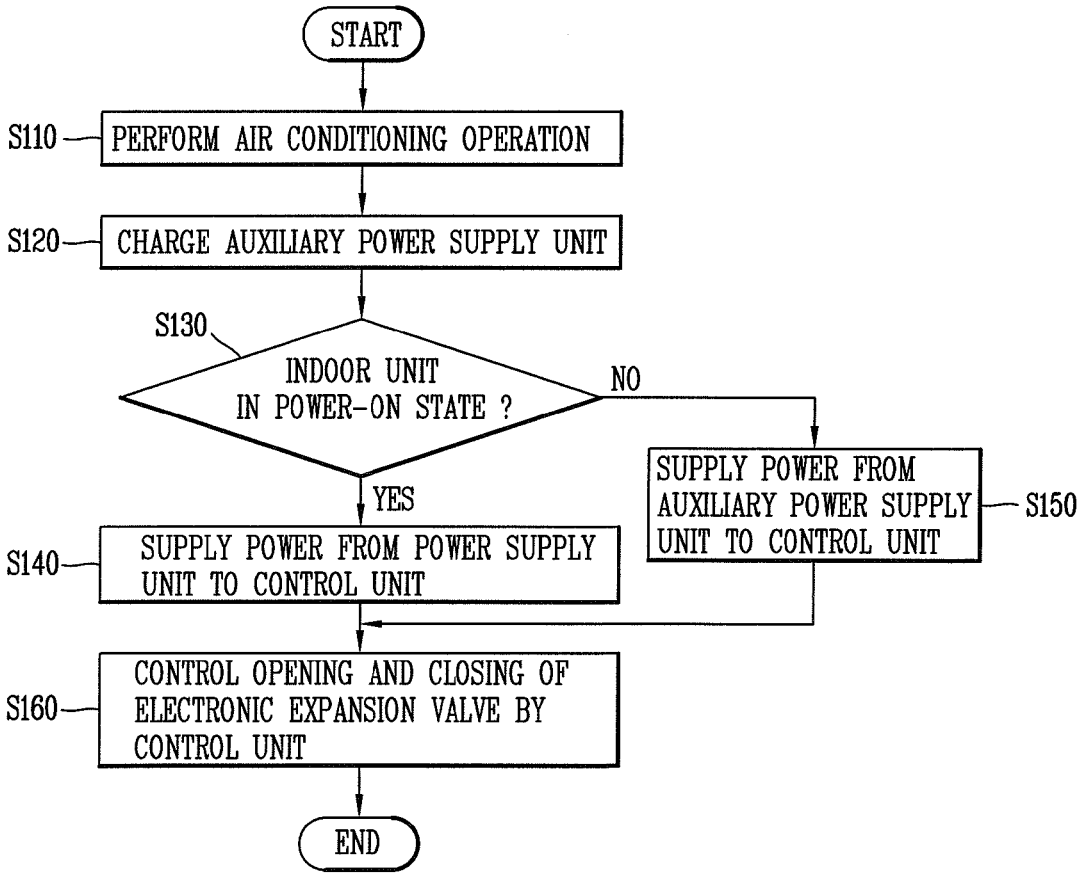
FIGS. 9 to 11 are flowcharts schematically showing a method for controlling an operation of an air conditioning system respectively in accordance with embodiments of the present invention.

Referring to FIG. 9, a method for controlling an operation of an air conditioning system in accordance with one embodiment of the present invention, in an air conditioning system having an indoor unit provided with a power supply unit connected to an external power source for supplying power into the indoor unit and an auxiliary power supply unit connected to the power supply unit to be charged or supply the charged power, may include charging the auxiliary power supply unit (S120), determining whether or not power is supplied from the power supply unit into the indoor unit (S130), and opening or closing an electronic expansion valve by receiving power supplied from the power supply unit or the auxiliary power supply unit (S140 to S160). The configuration of the device will be understood with reference to FIGS. 2 and 8.

The step of opening or closing the electronic expansion valve may include opening or closing the electronic expansion valve by receiving power supplied from the power supply unit if the power is being supplied into the indoor unit (S140).

Also, the step of opening or closing the electronic expansion valve may further include supplying power from the auxiliary power supply unit into the indoor unit if the power supplied into the indoor unit is blocked (S150), and opening or closing the electronic expansion valve by receiving power supplied from the auxiliary power supply unit (S160).

In the method for controlling the operation of the air conditioning system according to the one embodiment of the present invention, the indoor unit starts an air conditioning operation by receiving power supplied from the power supply unit (S110), and charges the auxiliary power supply unit with a surplus voltage (S120). The indoor unit then determines whether or not the power is kept supplied into the indoor unit (S130). If the power is determined to be continuously supplied into the indoor unit, the indoor unit outputs a control signal to an electronic expansion valve driving unit by receiving the power supplied from the power supply unit (S140). On the other hand, if the power supplied into the indoor unit is determined to be blocked, the indoor unit outputs a control signal to the electronic expansion valve driving unit by receiving power supplied from the auxiliary power supply unit (S150). The control unit thus controls the opening or closing of the electronic expansion valve by receiving power supplied from the power supply unit or the auxiliary power supply unit (S160).

Figure 10:
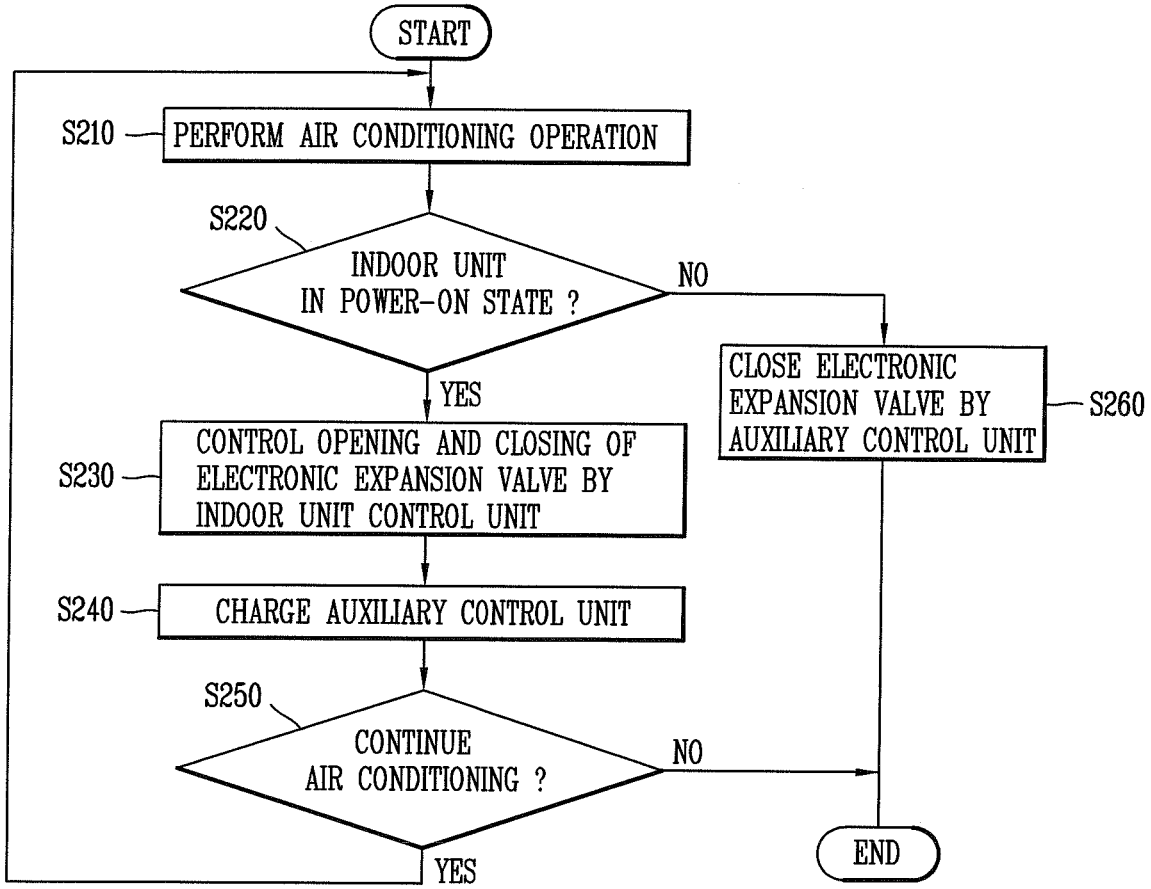

Referring to FIG. 10, a method for controlling an operation of an air conditioning system in accordance with another embodiment of the present invention, in an air conditioning system having an indoor unit provided with a power supply unit connected to an external power source for supplying power into the indoor unit, an indoor unit control unit for generating a valve driving signal for controlling opening or closing of an electronic expansion valve by receiving power supplied from the power supply unit, and an auxiliary control unit for generating a valve closing signal for closing the electronic expansion valve based upon a state of power supplied into the indoor unit, may include detecting the state of power supplied into the indoor unit (S220), and closing the electronic expansion valve according to the valve closing signal generated by the auxiliary control unit if the power supplied into the indoor unit is detected to be blocked (S260).

The method for controlling the operation of the air conditioning system according to the another embodiment of the present invention may further include controlling opening or closing of the electronic expansion valve according to the valve driving signal generated by the indoor unit control unit if the power is detected to be supplied into the indoor unit (S230), and charging the auxiliary control unit (S240). The configuration of the device will be understood with reference to FIGS. 3, 4 and 8.

In the method for controlling the operation of the air conditioning system according to the another embodiment of the present invention, the indoor unit starts an air conditioning operation by receiving power supplied from the power supply unit (S210). The indoor unit control unit operates the indoor unit or outputs a signal for driving the electronic expansion valve to an electronic expansion valve driving unit, by receiving power supplied from the power supply unit, if power is continuously supplied from the power supply unit into the indoor unit (S230). If the power supplied into the indoor unit is blocked during the operation of the electronic expansion valve, the driving of the electronic expansion valve by the indoor unit control unit may be stopped and thus the electronic expansion valve may be left open. Here, the auxiliary control unit continuously monitors the power supply state from the power supply unit, and then if the power supply is sustained, outputs a signal for closing the electronic expansion valve to the electronic expansion valve driving unit (S260).

Figure 11:
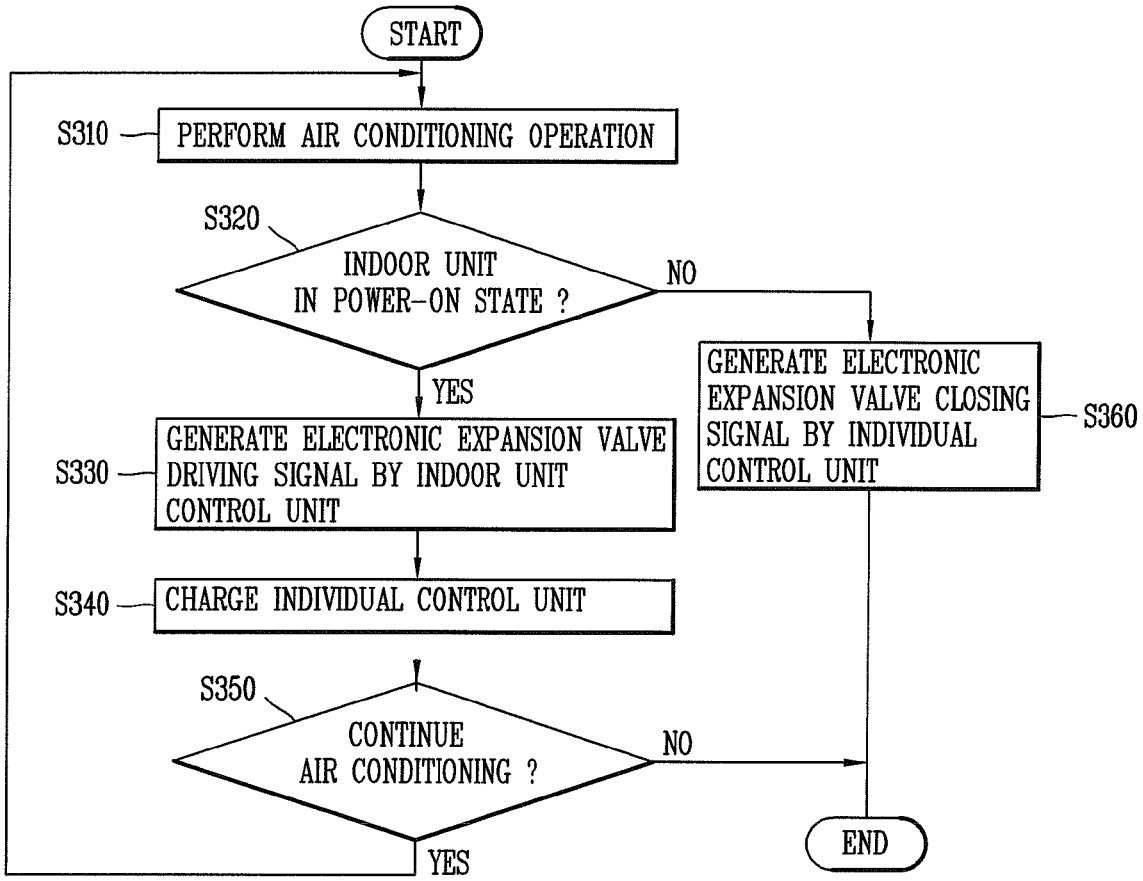

Referring to FIG. 11, a method for controlling an operation of an air conditioning system according to another embodiment of the present invention, in an air conditioning system having an indoor unit provided with an outdoor unit having a compressor for distributing a refrigerant, one or more indoor units each connected to the outdoor unit for performing an air conditioning operation, an electronic expansion valve for adjusting an amount of the refrigerant flowing, and an individual control unit connected between the indoor unit and the electronic expansion valve, may include detecting a state of power supplied into the indoor unit, and generating by the individual control unit a valve closing signal for closing the electronic expansion valve if the power supplied into the indoor unit is detected to be blocked. The configuration of the device will be understood with reference to FIGS. 5 to 8.

The method for controlling the operation of the air conditioning system according to the another embodiment of the present invention may further include generating a valve driving signal for controlling opening and closing of the electronic expansion valve if power is supplied into the indoor unit according to the detection result, driving the electronic expansion valve according to the valve driving signal, and charging the individual control unit.

In the method of controlling the operation of the air conditioning system in accordance with the another embodiment of the present invention, the indoor unit converts an AC voltage input from an external power source via the power supply unit into a DC voltage so as to start an air conditioning operation by using the DC voltage (S310). The indoor unit control unit operates the indoor unit or generate the valve driving signal to control opening and closing of the electronic expansion valve via the electronic expansion valve driving unit, by receiving power supplied from the power supply unit, if the power is kept supplied into the indoor unit via the power supply unit (S330). Here, the individual control unit continuously detects the power state supplied into the indoor unit. The individual control unit generates the valve closing signal if power supplied into the indoor unit is detected to be blocked during the operation of the electronic expansion valve (S360). The auxiliary power supply module within the individual control unit is charged by being connected to the power supply unit (S340), and then supplies power to the individual control unit if the power input into the indoor unit is blocked.

As described above, regarding an indoor unit, an air conditioning system having the indoor unit, and a method of controlling the air conditioning system according to the embodiments of the present invention, a charging device for charging power to be supplied into the indoor unit is employed, a chargeable control unit is separately employed, or a separate control unit connectable between the indoor unit and an electronic expansion valve is employed, thereby closing the electronic expansion valve even if power supplied into the indoor unit is blocked while controlling opening and closing of the electronic expansion valve, and additionally preventing the electronic expansion valve from being left open, resulting in prevention of an overload of a compressor within an indoor unit.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An air conditioning system comprising:

an outdoor unit having a compressor for distributing a refrigerant;

at least one indoor unit connected to the outdoor unit, the at least one indoor unit configured to perform an air conditioning operation;

an electronic expansion valve configured to adjust an amount of the refrigerant flowing between the compressor and the at least one indoor unit, wherein the electronic expansion valve is located between the outdoor unit and the at least one indoor unit; and an individual control unit that is located between the at least one indoor unit and the electronic expansion valve and detachably connected to both the at least one indoor unit and the electronic expansion valve;

wherein the at least one indoor unit comprises:

a power supply unit connected to an external power source to supply power to the at least one indoor unit;

an indoor unit control unit configured to generate a valve driving signal to control opening and closing of the electronic expansion valve based on the presence of power supplied from the power supply unit; and an electronic expansion valve driving unit configured to drive the electronic expansion valve based upon the valve driving signal when the individual control unit is not in a connected state with the indoor unit, wherein the individual control unit comprises:

a control module configured to detect a state of power received through the power supply unit of the at least one indoor unit and to generate a valve closing signal to close the electronic expansion valve when power supplied from the power supply unit into the at least one indoor unit is blocked during operation of the electronic expansion valve based upon a detection result;

a driving module configured to drive the electronic expansion valve based upon the received valve driving signal from the indoor unit when power is supplied from the power supply unit into the at least one indoor unit and the individual control unit is in the connected state with the indoor unit, wherein the driving module closes the electronic expansion valve based upon the valve closing signal; and and auxiliary power supply module configured to supply power to the control module and the driving module when power supplied from the power supply unit into the at least one indoor unit is blocked.

2. The air conditioning system according to claim 1, wherein the auxiliary power supply module comprises:

a capacitor, connected to the power supply unit, wherein the capacitor is charged if the power is supplied and discharged if the power is interrupted.

3. A method of controlling an operation of an air conditioning system, wherein the air conditioning system comprises an outdoor unit having a compressor for distributing a refrigerant, at least one indoor unit connected to the outdoor unit and configured to perform an air conditioning operation, an electronic expansion valve configured to adjust an amount of the refrigerant flowing between the compressor and the at least one indoor unit, wherein the electronic expansion valve is located between the outdoor unit and the at least one indoor unit, and an individual control unit that is located between the at least one indoor unit and the electronic expansion valve and detachably connected to both the at least one indoor unit and the electronic expansion valve, wherein the at least on indoor unit comprises:

a power supply unit connected to an external power source to supply power to the at least one indoor unit;

an indoor unit control unit configured to generate a valve driving signal to control opening and closing of the electronic expansion valve based on the presence of power supplied from the power supply unit; and an electronic expansion valve driving unit configured to drive the electronic expansion valve based upon the valve driving signal when the individual control unit is not in a connected state with the indoor unit, and the individual control unit is configured to receive the valve driving signal from the indoor unit and drive the electronic expansion valve based upon the valve driving signal when power is supplied from power supply unit into the at least one indoor unit and the individual control unit is in the connected state with the indoor unit, the method comprising:

detecting, by the individual control unit, a state of power received through the power supply unit of the at least one indoor unit; and generating, by the individual control unit, a valve closing signal to close the electronic expansion valve and closing the electronic expansion valve based upon the valve closing signal when the power supplied from the power supply unit into the at least one indoor unit is detected to be blocked during operation of the electronic expansion valve, wherein the method further comprises, if the power is detected to be supplied to the at least one indoor unit:

receiving, by the individual control unit, a valve driving signal from the indoor unit to control opening and closing of the electronic expansion valve;

driving the electronic expansion valve according to the valve driving signal; and charging the individual control unit.

4. The air conditioning system according to claim 1, wherein:

the individual control unit has an input terminal and an output terminal;

the input terminal is connected to the output terminal; and the output terminal is connected to the electronic expansion valve.

* * * * *